US010547138B1

(12) United States Patent
Huang et al.

(10) Patent No.: US 10,547,138 B1
(45) Date of Patent: Jan. 28, 2020

(54) LOAD-BEARING TYPE CIRCUIT CONNECTING DEVICE APPLICABLE TO FERRULE STRUCTURE AND CHRISTMAS TREE WITH THE DEVICE

(71) Applicants: Art Tree Crafts Manufacture Co., Ltd., Dongguan, Guangdong (CN); Zhongshan Jiaao Optoelectronic Technology Co., Ltd., Zhongshan, Guangdong (CN)

(72) Inventors: Biao Huang, Guangdong (CN); Zhiqiang Lan, Guangdong (CN)

(73) Assignees: Art Tree Crafts Manufacture Co., Ltd. (CN); Zhongshan Jiaao Optoelectronic Technology Co., Ltd. (CN)

( * ) Notice: Subject to any disclaimer, the term of this patent is extended or adjusted under 35 U.S.C. 154(b) by 0 days.

(21) Appl. No.: 16/409,783

(22) Filed: May 11, 2019

(30) Foreign Application Priority Data

Mar. 1, 2019 (CN) ..... 2019 1 0154786

(51) Int. Cl.

| | |
|---|---|
| ***H01R 13/66*** | (2006.01) |
| ***H01R 13/502*** | (2006.01) |
| ***H01R 33/72*** | (2006.01) |
| ***A47G 33/06*** | (2006.01) |
| ***H01R 33/20*** | (2006.01) |
| *A47G 33/08* | (2006.01) |

(52) U.S. Cl.
CPC ..... *H01R 13/502* (2013.01); *A47G 33/06* (2013.01); *H01R 33/20* (2013.01); *H01R 33/72* (2013.01); *A47G 2033/0827* (2013.01)

(58) Field of Classification Search
CPC ..... F21S 4/005; F21S 4/001; H01R 33/22; H01R 25/003; H01R 13/5833; H01R 13/58; F21V 21/08; F21V 4/001
USPC ..... 439/575, 602, 505, 456–460; 362/396, 362/252, 391, 806, 249, 250
See application file for complete search history.

(56) References Cited

U.S. PATENT DOCUMENTS

| | | | | |
|---|---|---|---|---|
| 9,080,754 | B2 * | 7/2015 | Lin | F21V 19/0025 |
| 9,915,401 | B2 * | 3/2018 | Russikoff | F21S 4/10 |
| 2014/0355277 | A1 * | 12/2014 | Lin | F21V 19/0025 362/391 |
| 2016/0153644 | A1 * | 6/2016 | Russikoff | F21S 4/10 362/396 |

* cited by examiner

*Primary Examiner* — Phuong Chi Thi Nguyen

(57) ABSTRACT

The present disclosure provides a load-bearing type circuit connecting device applicable to ferrule structure and an artificial Christmas tree with the device. A power source communicating device is provided with a first inserting connector and a second inserting connector, which are respectively assembled in an inner cavity of a first tree section and an inner cavity of a second tree section, wherein the first tree section and the second tree section are adjacent and are in inserting connection, and the first inserting connector and the second inserting connector are respectively provided with three or more electrical interfaces; and a first connecting end face of the first inserting connector is protruded from the inner cavity of the first tree section, and a second connecting end face of the second inserting connector is protruded from the inner cavity of the second tree section.

15 Claims, 2 Drawing Sheets

LOAD-BEARING TYPE CIRCUIT CONNECTING DEVICE APPLICABLE TO FERRULE STRUCTURE AND CHRISTMAS TREE WITH THE DEVICE

TECHNICAL FIELD

The present disclosure relates to the technical field of Christmas tree ornaments, and in particular to a load-bearing type circuit connecting device applicable to ferrule structure and an artificial Christmas tree with the device.

BACKGROUND

Decorative artificial Christmas tree has become one of indispensable articles at Christmas, and it creates the festive atmosphere to be increasingly loved by people. An artificial Christmas tree generally is composed of a tree trunk formed by a main rod, branches and leaves that are inserted into the main rod, and ornaments. The main rod not only has a function of supporting the whole artificial Christmas tree, but also has an important function of communicating a power source. Positive and negative conductors are arranged in a tree section, a plurality of jacks are arranged in the surface of the tree section according to specific requirements, the conductors are electrically connected with the corresponding jacks, an outer decorative lamp is powered on after a plug of the outer decorative lamp is inserted into a jack at a corresponding position, and lighting devices at all positions may be powered on through this manner.

The main rod is generally formed by connecting a plurality of tree sections in an insertion manner, and the insertion of every two adjacent tree sections achieves connection of the tree sections and electrical connection of the tree sections.

In the prior art, the two adjacent tree sections are generally respectively provided with an electrical plug; and in a tree section connecting process, the two electrical plugs are connected to achieve the electrical connection of the tree sections, and then the tree sections are fixed. However, the electrical plugs are generally located in the tree sections, and if the tree sections are not greatly fixed, the connection of the electrical plugs bears the supporting and connecting functions of the whole tree trunk, which is easy to cause deformation of the electrical plugs. Therefore, a problem of bad contact is easy to generate after the electrical connection structure in the prior art is used for a long term, which is a tough problem in the industry, and due to this problem, the artificial Christmas tree is easy to be scrapped.

Therefore, by aiming at deficiencies of the prior art, it is necessary to provide a load-bearing type circuit connecting device applicable to ferrule structure and an artificial Christmas tree with the device in order to overcome the deficiencies of the prior art.

SUMMARY

An objective of the present disclosure is to provide a load-bearing type circuit connecting device applicable to ferrule structure in order to avoid the deficiencies of the prior art, which may prevent electrical plugs from being under stress, deforming and damaging in an adjacent tree section inserting process and has the characteristic of good contact.

The objective of the present disclosure is achieved by the following technical scheme.

The present disclosure provides a load-bearing type circuit connecting device applicable to ferrule structure, which is provided with a first inserting connector and a second inserting connector, the first inserting connector and the second inserting connector are respectively assembled in an inner cavity of a first tree section and an inner cavity of a second tree section, the first tree section and the second tree section are adjacent and are in inserting connection, and the first inserting connector and the second inserting connector are respectively provided with three or more electrical interfaces; and a first connecting end face of the first inserting connector is used for being in inserting connection with the second inserting connector and is protruded from the inner cavity of the first tree section, and a second connecting end face of the second inserting connector is used for being in inserting connection with the first inserting connector and is protruded from the inner cavity of the second tree section.

Preferably, the first inserting connector and the second inserting connector are respectively provided with three electrical interfaces, specifically including: a positive interface, a negative interface and a signal interface, or a positive interface, a negative interface and an earth wire interface, and the electrical interfaces of the first inserting connector and the electrical interfaces of the second inserting connector are correspondingly communicated.

Another preferably, the first inserting connector and the second inserting connector are respectively provided with four electrical interfaces, specifically including: a positive interface, a negative interface, a signal interface and a reserved interface, or a positive interface, a negative interface, a signal interface and an earth wire interface, and the electrical interfaces of the first inserting connector and the electrical interfaces of the second inserting connector are correspondingly communicated.

Furthermore, the load-bearing type circuit connecting device applicable to ferrule structure is further provided with a first bearing seat and a second bearing seat; and the first inserting connector is assembled in the first bearing seat and is integrally assembled in the first tree section, and the second inserting connector is assembled in the second bearing seat and is integrally assembled in the second tree section.

Furthermore, in the load-bearing type circuit connecting device applicable to ferrule structure, at least a part of the first bearing seat is exposed from the inner cavity of the first tree section, and at least a part of the second bearing seat is exposed from the inner cavity of the second tree section.

Furthermore, in the load-bearing type circuit connecting device applicable to ferrule structure, the first bearing seat is provided with a first cylinder body and a first assembly ring part, the first cylinder body is fixedly connected with the first assembly ring part, the outer diameter of the first cylinder body is smaller than the outer diameter of the first assembly ring part, the outer diameter of the first cylinder body matches with the inner diameter of the first tree section, the first cylinder body is inserted in the inner cavity of the first tree section, and the first assembly ring part is exposed from the inner cavity of the first tree section; and the second bearing seat is provided with a second cylinder body and a second assembly ring part, the second cylinder body is fixedly connected with the second assembly ring part, the outer diameter of the second cylinder body is smaller than the outer diameter of the second assembly ring part, the outer diameter of the second cylinder body matches with the inner diameter of the second tree section, the second cylinder body is inserted in the inner cavity of the second tree section, and the second assembly ring part is exposed from the inner cavity of the second tree section.

Furthermore, the first inserting connector is provided with a first inserting connector body, one side of the first inserting connector body is provided with a through hole and a plurality of insulating ring bodies wound around the exterior of the through hole, conductive contacts are respectively arranged in the through hole, between the two adjacent insulating ring bodies, and on the outer wall of the outmost insulating ring body, and each conductive contact is respectively correspondingly connected with a conductor located on the other side of the first inserting connector body;

the first inserting connector body is further provided with a first ring part, and the first ring part is fixed on the outer wall surface of the first inserting connector body; a first stop ring and a first groove are arranged on the inner wall of the first bearing seat, and a gap is formed between the first stop ring and a port of the first bearing seat; the first ring part is mounted in the first groove and is propped against the first stop ring; the second inserting connector is provided with a second inserting connector body, one side of the second inserting connector body is provided with a conducting post and a plurality of conducting rings distributed at the exterior of the conducting post, the conducting post and one conducting ring or the two adjacent conducting rings are insulated with each other, and the conducting post and the conducting rings are respectively correspondingly connected with the conductors located on the other side of the second inserting connector body;

when the first inserting connector and the second inserting connector are assembled, the conducting post is inserted into the through hole, simultaneously the conducting rings are correspondingly inserted among the insulating ring bodies, and the conducting post and the conducting rings are respectively electrically connected with the corresponding conductive contacts;

the second inserting connector is further provided with a second ring part, the second ring part is fixed on the outer wall surface of the second inserting connector body, the second ring part is exposed from the second assembly ring part, and the outer diameter of the second ring part is equal to the outer diameter of the second assembly ring part; and when the first inserting connector and the second inserting connector are assembled, the second ring part is propped against an outer end face position, at which the second inserting connector is assembled, of the first assembly ring part, and an outer end face position, at which the first inserting connector is assembled, of the second inserting connector body is propped against the first stop ring.

Furthermore, the second assembly ring part is provided with an inserting groove, and the second inserting connector is inserted and assembled in the inserting groove.

Preferably, the outer diameter of the first assembly ring part is equal to the outer diameter of the first tree section, and the outer diameter of the second assembly ring part is equal to the outer diameter of the second tree section.

Preferably, the first ring part and the first inserting connector body are integrally formed, and the second ring part and the second inserting connector body are integrally formed.

The load-bearing type circuit connecting device applicable to ferrule structure, which is provided by the present disclosure, is provided with the first inserting connector and the second inserting connector, the first inserting connector and the second inserting connector are respectively assembled in the inner cavity of the first tree section and the inner cavity of the second tree section, the first tree section and the second tree section are adjacent and are in inserting connection, and the first inserting connector and the second inserting connector are respectively provided with three or more electrical interfaces; and the first connecting end face of the first inserting connector is used for being in inserting connection with the second inserting connector and is protruded from the inner cavity of the first tree section, and the second connecting end face of the second inserting connector is used for being in inserting connection with the first inserting connector and is protruded from the inner cavity of the second tree section. According to the power source communicating device, the first inserting connector and the second inserting connector are respectively provided with the plurality of electrical interfaces, so a plurality of functional interfaces may be achieved, and besides providence of positive and negative power sources, a signal interface and the like may be provided as required so that the application range of products is expanded. Connecting end faces of the first inserting connector and the second inserting connector are respectively protruded from the inner cavities of the corresponding tree sections, and in an adjacent tree section inserting process, the inserting process of the first inserting connector and the second inserting connector directly achieves the mounting of the two adjacent tree sections, thereby avoiding the defect of bad contact in use caused by the fact that the electrical plugs are easy to deform and damage under stress if the fixation of the tree sections is not completed after the inserting connection of two inserting connectors is completed in the prior art. The power source communicating device in the present disclosure has the characteristic of good contact.

Another objective of the present disclosure is to provide an artificial Christmas tree in order to avoid the deficiencies of the prior art, wherein the artificial Christmas tree adopts the load-bearing type circuit connecting device applicable to ferrule structure, which may prevent the electrical plugs from being under stress, deforming and damaging in the adjacent tree section inserting process and is in good contact in use.

BRIEF DESCRIPTION OF THE DRAWINGS

The present disclosure is further illustrated by utilizing the accompanying drawings, but the content of the accompanying drawings is not intended to limit the present disclosure.

In the FIG. 1, FIG. 2 and FIG. 3, numeric symbols are as follows: 100-first inserting connector, 110-first connecting end face, 120-first inserting connector body, 121-through hole, 122-insulating ring body, 123-conductive contact, 124-first ring part, 200-first tree section, 300-first bearing seat, 310-first cylinder body, 320-first assembly ring part, 321-first stop ring, 322-first groove, 400-second inserting connector, 410-second connecting end face, 420-second inserting connector body, 421-conducting post, 422-conducting ring, 423-second ring part, 500-second tree section, 600-second bearing seat, 610-second cylinder body, 620-second assembly ring part, 630-inserting groove and 700-conductor.

DESCRIPTION OF THE EMBODIMENTS

The present disclosure is further described in conjunction with the following embodiments.

Embodiment 1

Figure 1:
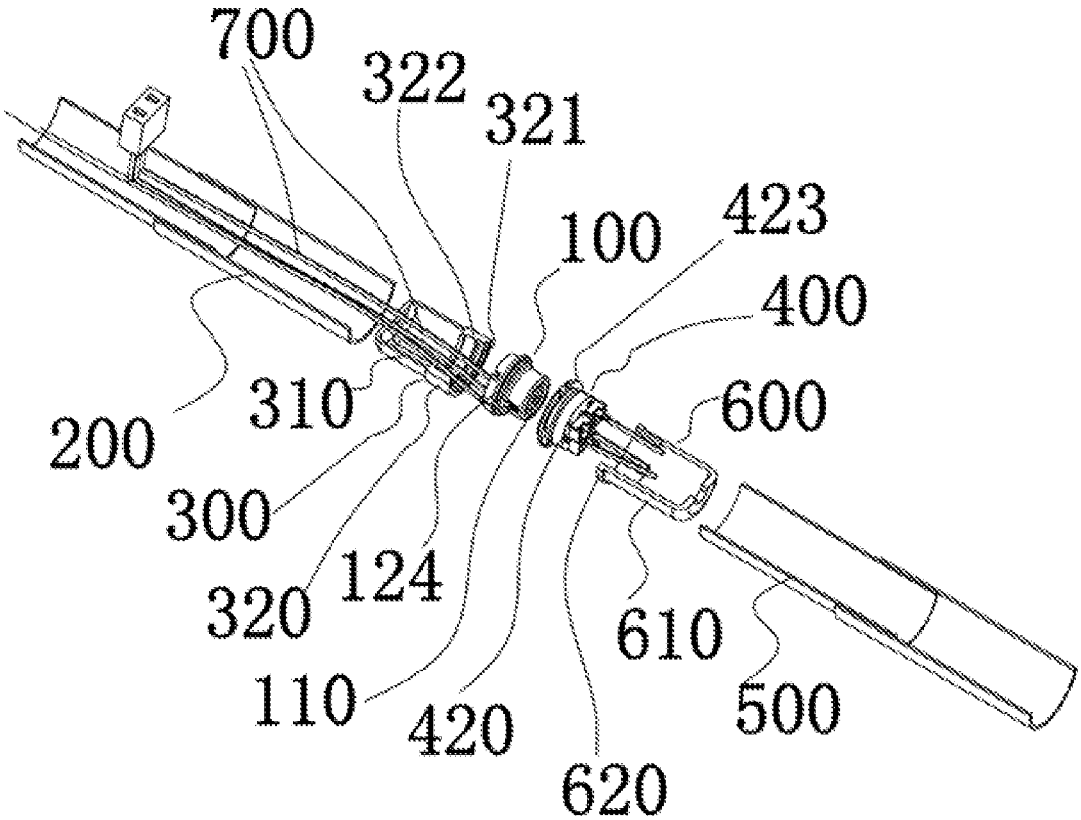
FIG. 1 is a schematic diagram of a sectional structure of a load-bearing type circuit connecting device applicable to ferrule structure in a decomposition state, provided by the present disclosure.
Figure 2:
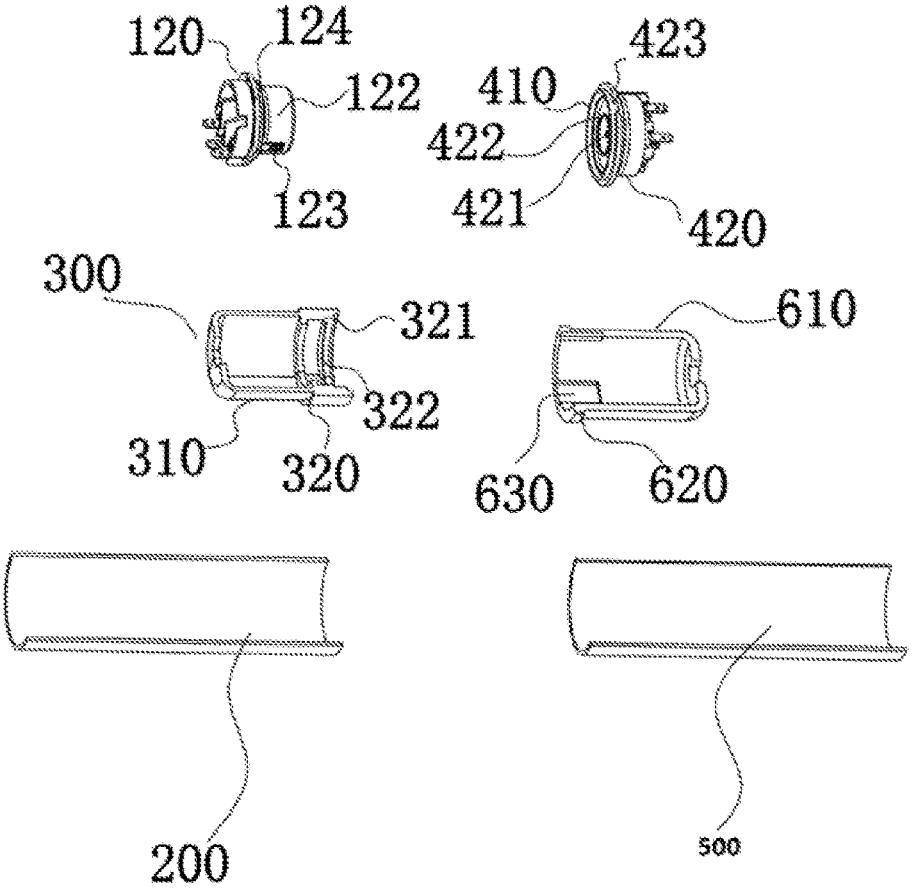
FIG. 2 is an exploded view of FIG. 1.
Figure 3:
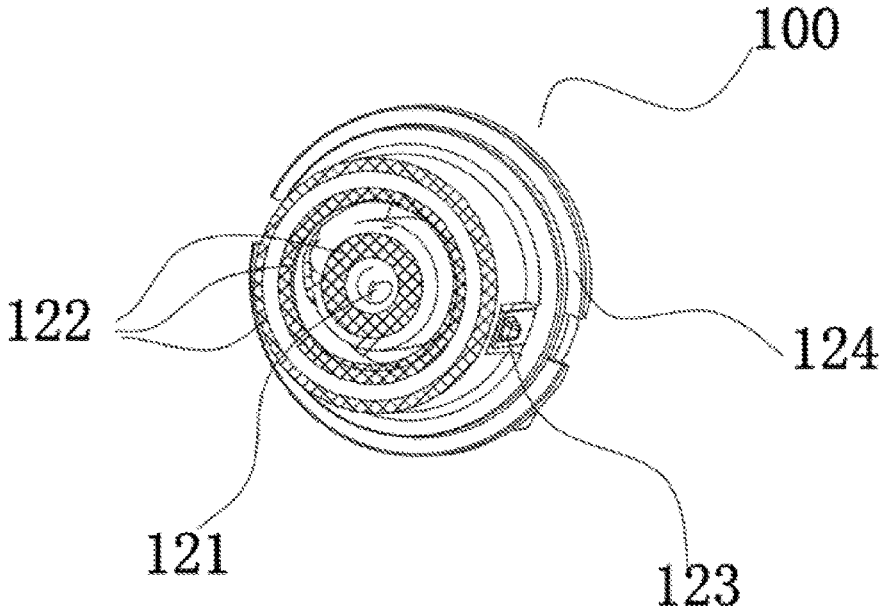
FIG. 3 is a structural schematic diagram of a first inserting connector in FIG. 1.

As shown in FIG. 1, FIG. 2 and FIG. 3, a load-bearing type circuit connecting device applicable to ferrule structure is provided with a first inserting connector 100 and a second inserting connector 400, the first inserting connector 100 and the second inserting connector 400 are respectively assembled in an inner cavity of a first tree section 200 and an inner cavity of a second tree section 500, the first tree section 200 and the second tree section 500 are adjacent and are in inserting connection, and the first inserting connector 100 and the second inserting connector 400 are respectively provided with three electrical interfaces.

The first tree section and the second tree section generally form the trunk of an artificial Christmas tree and mostly are hollow pipes made of metal, plastic and the like. Conductors are generally arranged in the first tree section and the second tree section, jacks are formed in some positions of the tree sections, and outer plugs may be inserted in the jacks in order to provide power for decorative lamps at corresponding positions. The artificial Christmas tree usually has a plurality of tree sections, but in the embodiment only two adjacent tree sections are taken as objects for description.

In the embodiment, the first inserting connector 100 and the second inserting connector 400 are respectively provided with three electrical interfaces, specifically including a positive interface, a negative interface and a signal interface, or a positive interface, a negative interface and an earth wire interface, and the electrical interfaces of the first inserting connector 100 and the electrical interfaces of the second inserting connector 400 are correspondingly communicated. The three electrical interfaces are arranged in order that one interface may be reserved, so the load-bearing type circuit connecting device applicable to ferrule structure has the characteristic of use flexibility.

It should be noted that: three electrical interfaces are arranged in the embodiment, but actually, the number of the electrical interfaces may be flexibly arranged according to specific conditions, and it is not limited to three and may also be four, five and the like, for example, the first inserting connector 100 and the second inserting connector 400 are respectively provided with four electrical interfaces, specifically including a positive interface, a negative interface, a signal interface and a reserved interface, or a positive interface, a negative interface, a signal interface and an earth wire interface.

A first connecting end face 110 of the first inserting connector 100 is used for being in inserting connection with the second inserting connector 400 and is protruded from the inner cavity of the first tree section 200, and a second connecting end face 410 of the second inserting connector 400 is used for being in inserting connection with the first inserting connector 100 and is protruded from the inner cavity of the second tree section 500, wherein the first connecting end face is a surface of one side, closest to the second inserting connector, of the first inserting connector, and the second connecting end face is a surface of one side, closest to the first inserting connector, of the second inserting connector.

The load-bearing type circuit connecting device applicable to ferrule structure is further provided with a first bearing seat 300 and a second bearing seat 600. The first inserting connector 100 is assembled in the first bearing seat 300 and is integrally assembled in the first tree section 200, and the second inserting connector 400 is assembled in the second bearing seat 600 and is integrally assembled in the second tree section 500.

At least a part of the first bearing seat 300 is exposed from the inner cavity of the first tree section 200, and at least a part of the second bearing seat 600 is exposed from the inner cavity of the second tree section 500.

Specifically, the first bearing seat 300 is provided with a first cylinder body 310 and a first assembly ring part 320, the first cylinder body 310 is fixedly connected with the first assembly ring part 320, the outer diameter of the first cylinder body 310 is smaller than the outer diameter of the first assembly ring part 320, the outer diameter of the first cylinder body 310 matches with the inner diameter of the first tree section 200, the first cylinder body 310 is inserted in the inner cavity of the first tree section 200, and the first assembly ring part 320 is exposed from the inner cavity of the first tree section 200.

the second bearing seat 600 is provided with a second cylinder body 610 and a second assembly ring part 620, the second cylinder body 610 is fixedly connected with the second assembly ring part 620, the outer diameter of the second cylinder body 610 is smaller than the outer diameter of the second assembly ring part 620, the outer diameter of the second cylinder body 610 matches with the inner diameter of the second tree section 500, the second cylinder body 610 is inserted in the inner cavity of the second tree section 500, and the second assembly ring part 620 is exposed from the inner cavity of the second tree section 500.

The outer diameter of the first assembly ring part 320 is equal to the outer diameter of the first tree section 200, and the outer diameter of the second assembly ring part 620 is equal to the outer diameter of the second tree section 500, so, when they are assembled integrally, the surface of the whole structure is flat.

Specifically, the first inserting connector 100 is provided with a first inserting connector body 120, one side of the first inserting connector body 120 is provided with a through hole 121 and a plurality of insulating ring bodies 122 wound around the exterior of the through hole 121, conductive contacts 123 are respectively arranged in the through hole 121, between the two adjacent insulating ring bodies 122, and on the outer wall of the outmost insulating ring body 122, and each conductive contact 123 is respectively correspondingly connected with a conductor 700 located on the other side of the first inserting connector body 120.

The first inserting connector body 120 is further provided with a first ring part 124, and the first ring part 124 is fixed on the outer wall surface of the first inserting connector body 120.

A first stop ring 321 and a first groove 322 are arranged on the inner wall of the first bearing seat 300, and a gap is formed between the first stop ring 321 and a port of the first bearing seat 300.

The first ring part 124 is mounted in the first groove 322 and is propped against the first stop ring 321.

The second inserting connector 400 is provided with a second inserting connector body 420, one side of the second inserting connector body 420 is provided with a conducting post 421 and a plurality of conducting rings 422 distributed at the exterior of the conducting post 421, the conducting post 421 and one conducting ring 422 or the two adjacent conducting rings 422 are insulated with each other, and the conducting post 421 and the conducting rings 422 are respectively correspondingly connected with the conductors 700 located on the other side of the second inserting connector body 420.

When the first inserting connector 100 and the second inserting connector 400 are assembled, the conducting post 421 is inserted into the through hole 121, simultaneously the conducting rings 422 are correspondingly inserted among the insulating ring bodies 122, and the conducting post 421 and the conducting rings are respectively electrically connected with the corresponding conductive contacts 123.

The second inserting connector 400 is further provided with a second ring part 423, the second ring part 423 is fixed on the outer wall surface of the second inserting connector body 420, the second ring part 423 is exposed from the second assembly ring part 620, and the outer diameter of the second ring part 423 is equal to the outer diameter of the second assembly ring part 620.

When the first inserting connector 100 and the second inserting connector 400 are assembled, the second ring part is propped against an outer end face position, at which the second inserting connector is assembled, of the first assembly ring part, and an outer end face position, at which the first inserting connector is assembled, of the second inserting connector body is propped against the first stop ring 321.

Specifically, the second assembly ring part 620 is provided with an inserting groove 630, and the second inserting connector is inserted and assembled in the inserting groove 630, thereby achieving the characteristic of assembly convenience.

An inserting assembly process of the load-bearing type circuit connecting device applicable to ferrule structure is as follows: by taking the first tree section 200 at the lower part of the artificial Christmas tree for an example, after the mounting of the first tree section 200 is completed, the second tree section 500, the first bearing seat 300 and the second inserting connector 400 that are assembled in the inner cavity of the second tree section are integrally inserted in the first tree section 200, at this time, the conducting post and the conducting rings of the second inserting connector are respectively correspondingly inserted into the through hole of the first inserting connector, between the through hole and the insulating ring body, between the insulating ring bodies or into an outer wall position, and after the second inserting connector and the first inserting connector are inserted properly, the second ring part is propped against the outer end face position, at which the second inserting connector is assembled, of the first assembly ring part, and the outer end face position, at which the first inserting connector is assembled, of the second inserting connector body is propped against the first stop ring 321, thereby avoiding the defect of bad contact in use caused by the fact that the electrical plugs are deformed and damaged under stress if the conducting parts are under stress in an inserting process.

According to the load-bearing type circuit connecting device applicable to ferrule structure, which is provided by the present disclosure, the first inserting connector 100 and the second inserting connector 400 are respectively provided with the plurality of electric interfaces, so a plurality of functional interfaces may be achieved, and besides providence of positive and negative power sources, a signal interface and the like may be provided as required so that the application range of products is expanded. Connecting end faces of the first inserting connector 100 and the second inserting connector 400 are respectively protruded from the inner cavities of the corresponding tree sections, and in an adjacent tree section inserting process, the inserting process of the first inserting connector 100 and the second inserting connector 400 directly achieves the mounting of the two adjacent tree sections, thereby avoiding the defect of bad contact in use caused by the fact that the electrical plugs are easy to deform and damage under stress if the fixation of the tree sections is not completed after the inserting connection of two inserting connectors is completed in the prior art. The power source communicating device in the present disclosure has the characteristic of good contact.

Embodiment 2

A load-bearing type circuit connecting device applicable to ferrule structure has the same structure as embodiment 1 except the following differences: the first inserting connector and the second inserting connector are respectively provided with four electrical interfaces, specifically including a positive interface, a negative interface, a signal interface and a reserved interface, or a positive interface, a negative interface, a signal interface and an earth wire interface. The first inserting connector and the second inserting connector are respectively provided with a plurality of electrical interfaces, so a plurality of functional interfaces may be achieved, and besides providence of positive and negative power sources, a signal interface and the like may be provided as required so that the application range of products is expanded.

Embodiment 3

An artificial Christmas tree has the load-bearing type circuit connecting device applicable to ferrule structure in embodiment 1 or embodiment 2, which does not make electrical plugs under stress and does not cause deformation and damage of the electrical plugs in an adjacent tree section inserting process, thereby having the advantage of good contact.

Finally, it should be noted that: the above embodiments are merely used for describing the technical scheme of the present disclosure, but not intended to limit the protection scope of the present disclosure. Although the present disclosure is described in detail according to preferable embodiments, those of ordinary skills in the art should understand that the technical schemes of the present disclose may be modified or equivalently substituted without departing from the spirit and protection scope of the present disclosure.

The invention claimed is:

1. A load-bearing type circuit connecting device applicable to ferrule structure, a first inserting connector and a second inserting connector are arranged, the first inserting connector and the second inserting connector are respectively assembled in an inner cavity of a first tree section and an inner cavity of a second tree section, the first tree section and the second tree section are adjacent and are in inserting connection, and the first inserting connector and the second inserting connector are respectively provided with three or more electrical interfaces; and a first connecting end face of the first inserting connector is used for being in inserting connection with the second inserting connector and is protruded from the inner cavity of the first tree section, and a second connecting end face of the second inserting connector is used for being in inserting connection with the first inserting connector and is protruded from the inner cavity of the second tree section;

wherein the first bearing seat is provided with a first cylinder body and a first assembly ring part, the first cylinder body is fixedly connected with the first assembly ring part, the outer diameter of the first cylinder body is smaller than the outer diameter of the first assembly ring part, the outer diameter of the first cylinder body matches with the inner diameter of the first tree section, the first cylinder body is inserted in the inner cavity of the first tree section, and the first assembly ring part is exposed from the inner cavity of the first tree section; and the second bearing seat is provided with a second cylinder body and a second assembly ring part, the second cylinder body is fixedly connected with the second assembly ring part, the outer diameter of the second cylinder body is smaller than the outer diameter of the second assembly ring part, the outer diameter of the second cylinder body matches with the inner diameter of the second tree section, the second cylinder body is inserted in the inner cavity of the second tree section, and the second assembly ring part is exposed from the inner cavity of the second tree section;

wherein the first inserting connector is provided with a first inserting connector body, one side of the first inserting connector body is provided with a through hole and a plurality of insulating ring bodies wound around the exterior of the through hole, conductive contacts are respectively arranged in the through hole, between the two adjacent insulating ring bodies, and on the outer wall of the outmost insulating ring body, and each conductive contact is respectively correspondingly connected with a conductor located on the other side of the first inserting connector body; the first inserting connector body is further provided with a first ring part, and the first ring part is fixed on the outer wall surface of the first inserting connector body; a first stop ring and a first groove are arranged on the inner wall of the first bearing seat, and a gap is formed between the first stop ring and a port of the first bearing seat; the first ring part is mounted in the first groove and is propped against the first stop ring; the second inserting connector is provided with a second inserting connector body, one side of the second inserting connector body is provided with a conducting post and a plurality of conducting rings distributed at the exterior of the conducting post, the conducting post and one conducting ring or the two adjacent conducting rings are insulated with each other, and the conducting post and the conducting rings are respectively correspondingly connected with the conductors located on the other side of the second inserting connector body; when the first inserting connector and the second inserting connector are assembled, the conducting post is inserted into the through hole, simultaneously the conducting rings are correspondingly inserted among the insulating ring bodies, and the conducting post and the conducting rings are respectively electrically connected with the corresponding conductive contacts; the second inserting connector is further provided with a second ring part, the second ring part is fixed on the outer wall surface of the second inserting connector body, the second ring part is exposed from the second assembly ring part, and the outer diameter of the second ring part is equal to the outer diameter of the second assembly ring part; and when the first inserting connector and the second inserting connector are assembled, the second ring part is propped against an outer end face position, at which the second inserting connector is assembled, of the first assembly ring part, and an outer end face position, at which the first inserting connector is assembled, of the second inserting connector body is propped against the first stop ring.

2. The load-bearing type circuit connecting device applicable to ferrule structure of claim 1, wherein the first inserting connector and the second inserting connector are respectively provided with four electrical interfaces, specifically including:

a positive interface, a negative interface, a signal interface and a reserved interface, or a positive interface, a negative interface, a signal interface and an earth wire interface, and the electrical interfaces of the first inserting connector and the electrical interfaces of the second inserting connector are correspondingly communicated.

3. The load-bearing type circuit connecting device applicable to ferrule structure of claim 1, wherein the first inserting connector and the second inserting connector are respectively provided with three electrical interfaces, specifically including:

a positive interface, a negative interface and a signal interface, or a positive interface, a negative interface and an earth wire interface, and the electrical interfaces of the first inserting connector and the electrical interfaces of the second inserting connector are correspondingly communicated.

4. The load-bearing type circuit connecting device applicable to ferrule structure of claim 3, wherein a first bearing seat and a second bearing seat is further arranged; and the first inserting connector is assembled in the first bearing seat and is integrally assembled in the first tree section, and the second inserting connector is assembled in the second bearing seat and is integrally assembled in the second tree section.

5. The load-bearing type circuit connecting device applicable to ferrule structure of claim 4, wherein at least a part of the first bearing seat is exposed from the inner cavity of the first tree section, and at least a part of the second bearing seat is exposed from the inner cavity of the second tree section.

6. The load-bearing type circuit connecting device applicable to ferrule structure of claim 5 wherein the second assembly ring part is provided with an inserting groove, and the second inserting connector is inserted and assembled in the inserting groove.

7. The load-bearing type circuit connecting device applicable to ferrule structure of claim 6, wherein the outer diameter of the first assembly ring part is equal to the outer diameter of the first tree section, and the outer diameter of the second assembly ring part is equal to the outer diameter of the second tree section.

8. An artificial Christmas tree, characterized by having the load-bearing type circuit connecting device applicable to ferrule structure comprises:

A load-bearing type circuit connecting device applicable to ferrule structure, a first inserting connector and a second inserting connector are arranged, the first inserting connector and the second inserting connector are respectively assembled in an inner cavity of a first tree section and an inner cavity of a second tree section, the first tree section and the second tree section are adjacent and are in inserting connection, and the first inserting connector and the second inserting connector are respectively provided with three or more electrical interfaces; and a first connecting end face of the first inserting connector is used for being in inserting connection with the second inserting connector and is protruded from the inner cavity of the first tree section, and a second connecting end face of the second inserting connector is used for being in inserting connection with the first inserting connector and is protruded from the inner cavity of the second tree section;

wherein the first bearing seat is provided with a first cylinder body and a first assembly ring part, the first cylinder body is fixedly connected with the first assembly ring part, the outer diameter of the first cylinder body is smaller than the outer diameter of the first assembly ring part, the outer diameter of the first cylinder body matches with the inner diameter of the first tree section, the first cylinder body is inserted in the inner cavity of the first tree section, and the first assembly ring part is exposed from the inner cavity of the first tree section; and the second bearing seat is provided with a second cylinder body and a second assembly ring part, the second cylinder body is fixedly connected with the second assembly ring part, the outer diameter of the second cylinder body is smaller than the outer diameter of the second assembly ring part, the outer diameter of the second cylinder body matches with the inner diameter of the second tree section, the second cylinder body is inserted in the inner cavity of the second tree section, and the second assembly ring part is exposed from the inner cavity of the second tree section;

wherein the first inserting connector is provided with a first inserting connector body, one side of the first inserting connector body is provided with a through hole and a plurality of insulating ring bodies wound around the exterior of the through hole, conductive contacts are respectively arranged in the through hole, between the two adjacent insulating ring bodies, and on the outer wall of the outmost insulating ring body, and each conductive contact is respectively correspondingly connected with a conductor located on the other side of the first inserting connector body; the first inserting connector body is further provided with a first ring part, and the first ring part is fixed on the outer wall surface of the first inserting connector body; a first stop ring and a first groove are arranged on the inner wall of the first bearing seat, and a gap is formed between the first stop ring and a port of the first bearing seat; the first ring part is mounted in the first groove and is propped against the first stop ring; the second inserting connector is provided with a second inserting connector body, one side of the second inserting connector body is provided with a conducting post and a plurality of conducting rings distributed at the exterior of the conducting post, the conducting post and one conducting ring or the two adjacent conducting rings are insulated with each other, and the conducting post and the conducting rings are respectively correspondingly connected with the conductors located on the other side of the second inserting connector body; when the first inserting connector and the second inserting connector are assembled, the conducting post is inserted into the through hole, simultaneously the conducting rings are correspondingly inserted among the insulating ring bodies, and the conducting post and the conducting rings are respectively electrically connected with the corresponding conductive contacts; the second inserting connector is further provided with a second ring part, the second ring part is fixed on the outer wall surface of the second inserting connector body, the second ring part is exposed from the second assembly ring part, and the outer diameter of the second ring part is equal to the outer diameter of the second assembly ring part; and when the first inserting connector and the second inserting connector are assembled, the second ring part is propped against an outer end face position, at which the second inserting connector is assembled, of the first assembly ring part, and an outer end face position, at which the first inserting connector is assembled, of the second inserting connector body is propped against the first stop ring.

9. The artificial Christmas tree of claim 8, wherein the first inserting connector and the second inserting connector are respectively provided with three electrical interfaces, specifically including:

a positive interface, a negative interface and a signal interface, or a positive interface, a negative interface and an earth wire interface, and the electrical interfaces of the first inserting connector and the electrical interfaces of the second inserting connector are correspondingly communicated.

10. The artificial Christmas tree of claim 9, wherein a first bearing seat and a second bearing seat is further arranged; and the first inserting connector is assembled in the first bearing seat and is integrally assembled in the first tree section, and the second inserting connector is assembled in the second bearing seat and is integrally assembled in the second tree section.

11. The artificial Christmas tree of claim 10, wherein at least a part of the first bearing seat is exposed from the inner cavity of the first tree section, and at least a part of the second bearing seat is exposed from the inner cavity of the second tree section.

12. The artificial Christmas tree of claim 11, wherein the first bearing seat is provided with a first cylinder body and a first assembly ring part, the first cylinder body is fixedly connected with the first assembly ring part, the outer diameter of the first cylinder body is smaller than the outer diameter of the first assembly ring part, the outer diameter of the first cylinder body matches with the inner diameter of the first tree section, the first cylinder body is inserted in the inner cavity of the first tree section, and the first assembly ring part is exposed from the inner cavity of the first tree section; and the second bearing seat is provided with a second cylinder body and a second assembly ring part, the second cylinder body is fixedly connected with the second assembly ring part, the outer diameter of the second cylinder body is smaller than the outer diameter of the second assembly ring part, the outer diameter of the second cylinder body matches with the inner diameter of the second tree section, the second cylinder body is inserted in the inner cavity of the second tree section, and the second assembly ring part is exposed from the inner cavity of the second tree section.

13. The artificial Christmas tree of claim 12, wherein the first inserting connector is provided with a first inserting connector body, one side of the first inserting connector body is provided with a through hole and a plurality of insulating ring bodies wound around the exterior of the through hole, conductive contacts are respectively arranged in the through hole, between the two adjacent insulating ring bodies, and on the outer wall of the outmost insulating ring body, and each conductive contact is respectively correspondingly connected with a conductor located on the other side of the first inserting connector body; the first inserting connector body is further provided with a first ring part, and the first ring part is fixed on the outer wall surface of the first inserting connector body; a first stop ring and a first groove are arranged on the inner wall of the first bearing seat, and a gap is formed between the first stop ring and a port of the first bearing seat; the first ring part is mounted in the first groove and is propped against the first stop ring; the second inserting connector is provided with a second inserting connector body, one side of the second inserting connector body is provided with a conducting post and a plurality of conducting rings distributed at the exterior of the conducting post, the conducting post and one conducting ring or the two adjacent conducting rings are insulated with each other, and the conducting post and the conducting rings are respectively correspondingly connected with the conductors located on the other side of the second inserting connector body; when the first inserting connector and the second inserting connector are assembled, the conducting post is inserted into the through hole, simultaneously the conducting rings are correspondingly inserted among the insulating ring bodies, and the conducting post and the conducting rings are respectively electrically connected with the corresponding conductive contacts; the second inserting connector is further provided with a second ring part, the second ring part is fixed on the outer wall surface of the second inserting connector body, the second ring part is exposed from the second assembly ring part, and the outer diameter of the second ring part is equal to the outer diameter of the second assembly ring part; and when the first inserting connector and the second inserting connector are assembled, the second ring part is propped against an outer end face position, at which the second inserting connector is assembled, of the first assembly ring part, and an outer end face position, at which the first inserting connector is assembled, of the second inserting connector body is propped against the first stop ring.

14. The artificial Christmas tree of claim 13, wherein the second assembly ring part is provided with an inserting groove, and the second inserting connector is inserted and assembled in the inserting groove.

15. The artificial Christmas tree of claim 14, wherein the outer diameter of the first assembly ring part is equal to the outer diameter of the first tree section, and the outer diameter of the second assembly ring part is equal to the outer diameter of the second tree section.

* * * * *